US005819574A

United States Patent [19]

Yogo

[11] Patent Number: 5,819,574

[45] Date of Patent: Oct. 13, 1998

[54] HYDRAULIC DEVICE FOR BENDING WORK AND A BENDING DEVICE WITH THE HYDRAULIC DEVICE MOUNTED THEREON

[75] Inventor: Toruaki Yogo, Nagoya, Japan

[73] Assignee: Kabushiki Kaisha Opton, Seto, Japan

[21] Appl. No.: 867,905

[22] Filed: Jun. 3, 1997

[30] Foreign Application Priority Data

Jun. 7, 1996 [JP] Japan ..... 8-146182
Jun. 14, 1996 [JP] Japan ..... 8-154290

[51] Int. Cl.[6] ..... B21D 7/04; B21B 37/08

[52] U.S. Cl. ..... 72/155; 72/149; 72/20.1; 60/476; 60/484

[58] Field of Search ..... 7/149, 153, 154, 7/155, 156, 157, 158, 367.1, 369, 370.01, 19.8, 20.1, 20.2; 60/476, 484; 228/146, 147, 155

[56] References Cited

U.S. PATENT DOCUMENTS

| | | | |
|---|---|---|---|
| 5,259,224 | 11/1993 | Schwarze | 72/149 |
| 5,343,725 | 9/1994 | Sabine | 72/149 |
| 5,632,176 | 5/1997 | Bhandari | 72/149 |

FOREIGN PATENT DOCUMENTS

| | | |
|---|---|---|
| 0 661 115 A1 | 7/1995 | European Pat. Off. . |
| 2 426 174 | 12/1979 | France . |
| 63-23002 | 1/1988 | Japan . |
| 2-17204 | 1/1990 | Japan . |
| 2-38020 | 2/1990 | Japan . |
| 797354 | 7/1958 | United Kingdom . |
| 2 196 758 | 5/1988 | United Kingdom . |

*Primary Examiner*—Joseph J. Hail, III
*Assistant Examiner*—Rodney Butler
*Attorney, Agent, or Firm*—Davis and Bujold

[57] ABSTRACT

A hydraulic device provided with a plurality of hydraulic actuators directly connected to a hydraulic pump for control. A hydraulic pump is operable in both rotational directions when the electric motor is rotated forwards and in reverse. Ports of each hydraulic actuator are connected via a connecting line in parallel with ports of the hydraulic pump. A plurality of electromagnetic valves are provided in the connecting lines to the hydraulic actuators. By opening or closing each electromagnetic valve, the operation of the associated hydraulic actuator is controlled. The operation direction of each hydraulic actuator is controlled by rotating the electric motor clockwise or counterclockwise. Further, a position sensor is provided for detecting displacement of the specified hydraulic actuator and the electric motor is controlled based on a signal transmitted from the position sensor.

9 Claims, 9 Drawing Sheets

HYDRAULIC DEVICE FOR BENDING WORK AND A BENDING DEVICE WITH THE HYDRAULIC DEVICE MOUNTED THEREON

BACKGROUND OF THE INVENTION

The invention relates to a hydraulic device for operating a hydraulic actuator with liquid under pressure supplied by a hydraulic pump operated by an electric motor.

The invention also relates to a bending device for bending a workpiece by supplying liquid under pressure to a hydraulic actuator from a hydraulic pump operated by an electric motor, and rotating a bending arm.

Conventionally, a drive device directly driven by a servo motor has been used. When a large drive force is necessary, a hydraulic device is used, in which pressure liquid is supplied from a hydraulic pump driven by a motor to a hydraulic actuator, such that a larger drive force is obtained from the hydraulic actuator. The hydraulic device, however, requires an electric motor, a hydraulic pump, a hydraulic tank, a control valve and other hydraulic components, thereby enlarging its entire size. To reduce the entire size, Japanese Patent Application laid-open No. 63-23002 discloses that a hydraulic pump rotatable both clockwise and counterclockwise is provided for discharging liquid under pressure in opposite directions, ports of the hydraulic pump are directly connected to ports of a hydraulic actuator, under the control of an electric motor for operating the hydraulic pump.

In the prior-art hydraulic device, although one hydraulic actuator can be operated with the electric motor and the hydraulic pump, the hydraulic pump and the electric motor must be disposed for each hydraulic actuator. Therefore, if a plurality of hydraulic actuators are necessary, the entire size of the hydraulic device is increased.

When a large drive force is required in a conventional bending device, liquid under pressure is supplied from a hydraulic pump driven by a motor to a hydraulic actuator, and a larger drive force for use in bending work is derived from the hydraulic actuator. Further, since the rotary angle of a bending arm varies with the workpiece, the rotary angle of the bending arm is detected and the bending arm is rotated through a predetermined angle by the hydraulic actuator. Additionally, during bending, pressure is applied in the axial direction to the workpiece by the hydraulic actuator, such that the thickness of a bent portion of the workpiece is prevented from being excessively reduced.

In the conventional bending device, however, the rotary angle of the bending arm has to be controlled synchronously with operation of the hydraulic actuator for applying pressure. For this purpose, liquid under pressure supplied to the hydraulic actuator must be controlled. Such control requires a precise flow control valve, a relief valve and other control valves.

SUMMARY OF THE INVENTION

An object of the invention is to provide a hydraulic device in which a plurality of hydraulic actuators are connected to a hydraulic pump for operation and control.

Another object of the invention is to provide a bending device in which bending of a workpiece can be controlled without requiring a precise flow control valve or a relief valve.

To attain these and other objects, the present invention provides a hydraulic device provided with a plurality of hydraulic actuators, and a control circuit having a hydraulic pump and a motor for operating the hydraulic pump. The hydraulic actuators are operated in a predetermined order with the pressure liquid supplied from the hydraulic pump. The hydraulic pump can be rotated both clockwise and counterclockwise by rotating the motor forwards and in reverse. Two ports of each hydraulic actuator are connected in parallel with two ports of the hydraulic pump. An electromagnetic valve is provided for each hydraulic actuator. The hydraulic actuators are controlled by opening or closing the electromagnetic valves and the operation direction of the hydraulic actuators is controlled by rotating the motor forwards and in reverse.

A position sensor is provided for detecting displacement of one specified actuator selected from the plurality of hydraulic actuators. In the control circuit the motor can be electrically controlled by a signal transmitted from the position sensor.

Each hydraulic actuator is a hydraulic cylinder, and a hydraulic tank is provided corresponding to the volume of the cylinder rod. The hydraulic tank is connected via a pilot check valve to both ports of the hydraulic pump.

The present invention further provides a bending device provided with a bending form according to a bending configuration of a longitudinal workpiece, a bending arm rotatably supported about the bending form, and a press form movably supported on the bending arm. The press form is moved toward the workpiece, such that the workpiece is held between the bending form and the press form. Pressure liquid is supplied to a hydraulic actuator for rotating the bending arm. The bending device is provided with a bending hydraulic mechanism having a hydraulic pump operated by a motor and a control circuit. The hydraulic pump can be rotated both clockwise and counterclockwise by rotating the motor correspondingly. Two ports of the hydraulic pump are connected in parallel to two ports of the hydraulic actuator. In the control circuit a rotation sensor is provided for detecting the rotary angle of the bending arm. The motor is controlled based on the rotary angle detected by the rotation sensor. The operation direction of the hydraulic actuator is controlled by rotating the motor forwardly and in reverse.

The bending device is further provided with a press hydraulic mechanism, in which both ports of the hydraulic pump rotatable both clockwise and counterclockwise are connected via a connecting line to a press hydraulic actuator. The bending device is also provided with a speed sensor for detecting the operation speed of the press hydraulic actuator.

Further, the bending device is provided with a follow-up controller for controlling the number of revolutions of the motor in the press hydraulic mechanism based on the rotary angle of the bending arm detected by the rotation sensor and the operation speed of the press hydraulic actuator detected by the speed sensor, and operating the press hydraulic actuator following the rotation of the bending arm.

In addition to the press hydraulic mechanism, the bending device may be provided with a pressure sensor for detecting the pressure of liquid under pressure supplied from the press hydraulic mechanism to the press hydraulic actuator, and a press controller. In the press controller, the maximum pressure supplied to the press hydraulic actuator is controlled by the maximum current supplied to the motor, when electric, of the press hydraulic mechanism based on the rotary angle of the bending arm detected by the rotation sensor.

According to the invention, a bending device can be provided with the press hydraulic mechanism, the speed sensor, the pressure sensor and the follow-up controller and the press controller.

The press hydraulic actuator can be operated for moving a pressure form for receiving bending stress during bending work in the axial direction of the workpiece, or for pushing forward the rear end of the workpiece in the axial direction.

DETAILED DESCRIPTION OF THE PREFERRED EMBODIMENTS

First Embodiment

Figure 1:
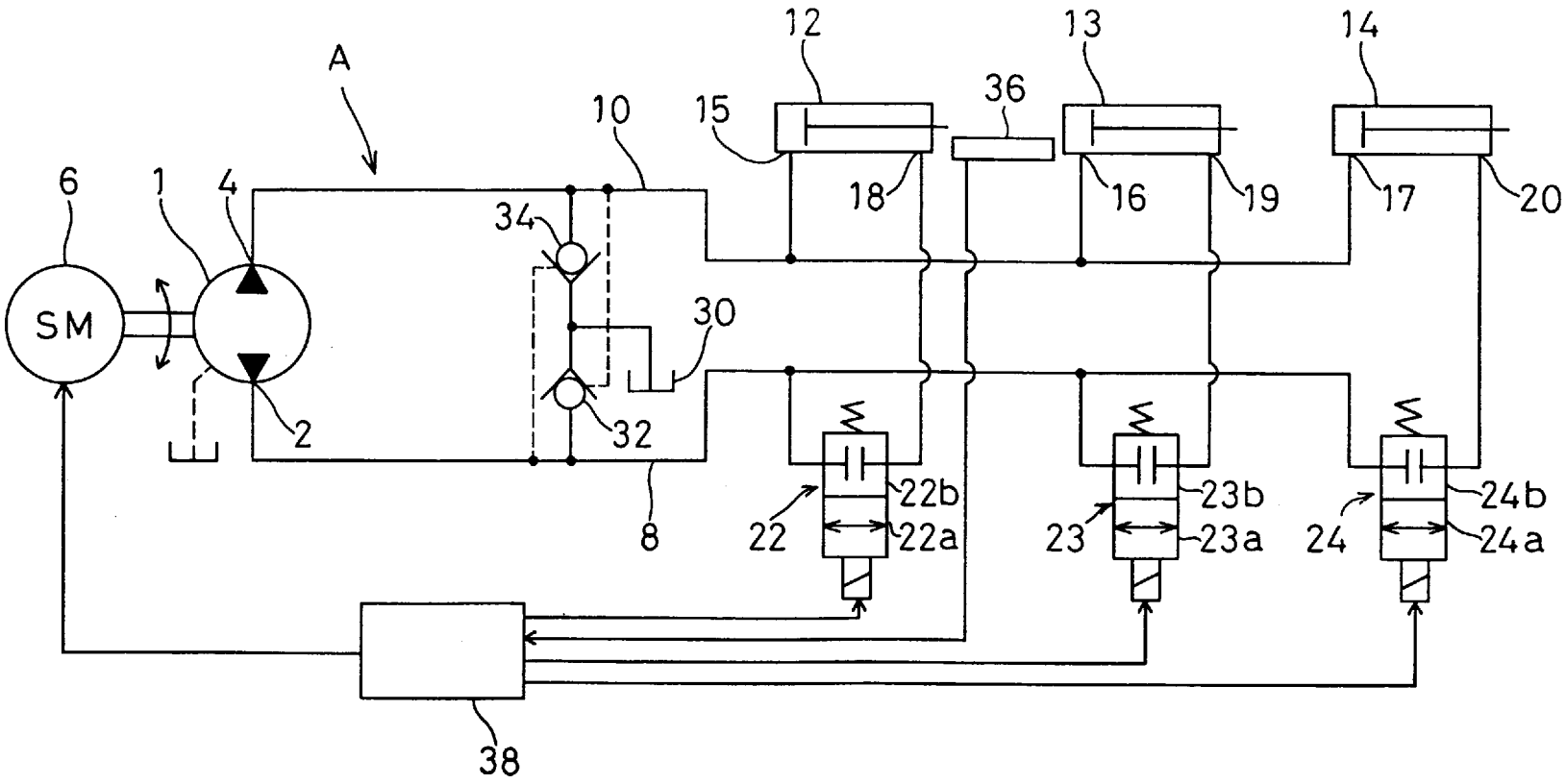
FIG. 1 is a circuit diagram of a hydraulic device for use in a bending device, according to a first embodiment of the present invention.
Figure 2:
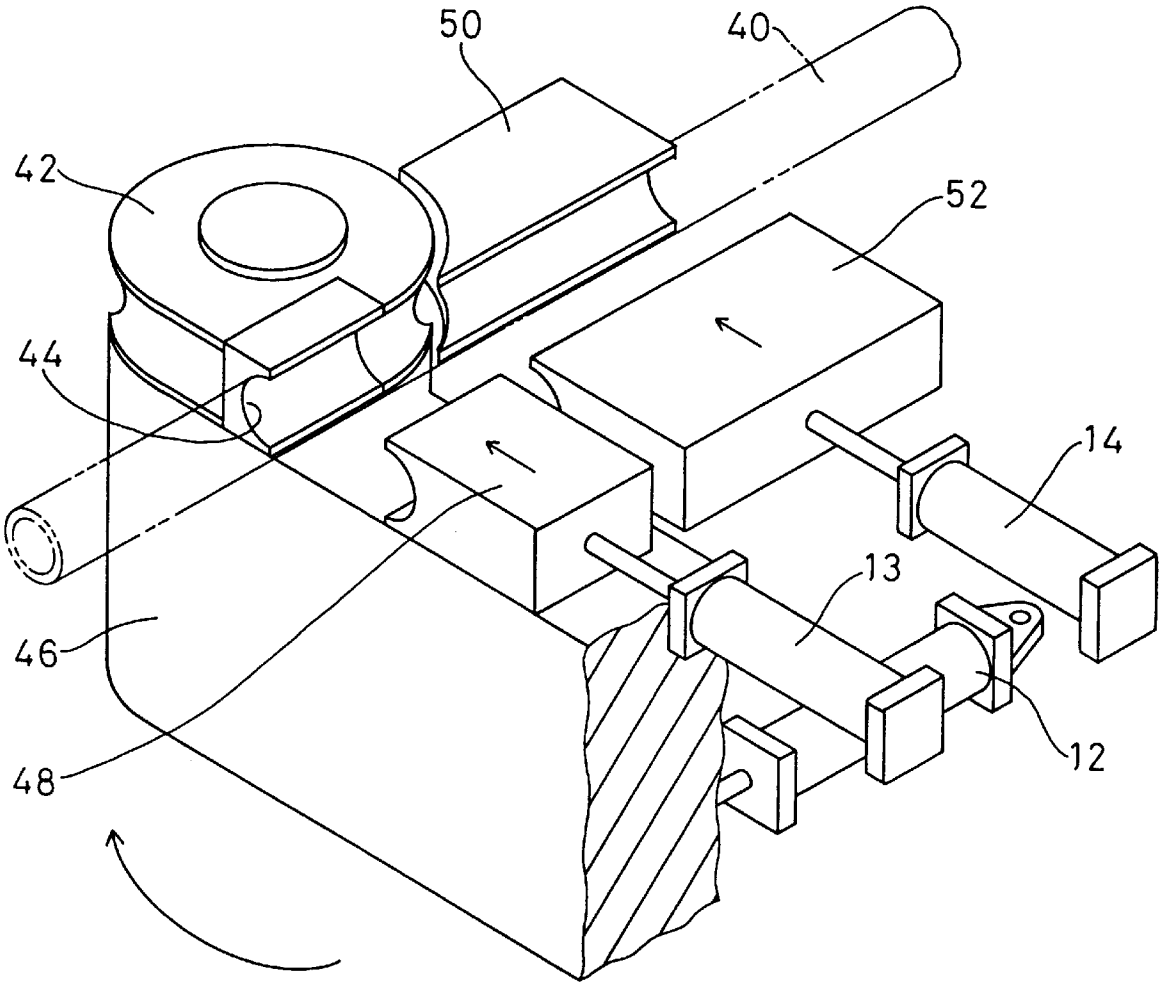
FIG. 2 is a fragmentary perspective view showing the bending device to which the hydraulic device of the first embodiment is mounted.
Figure 3:
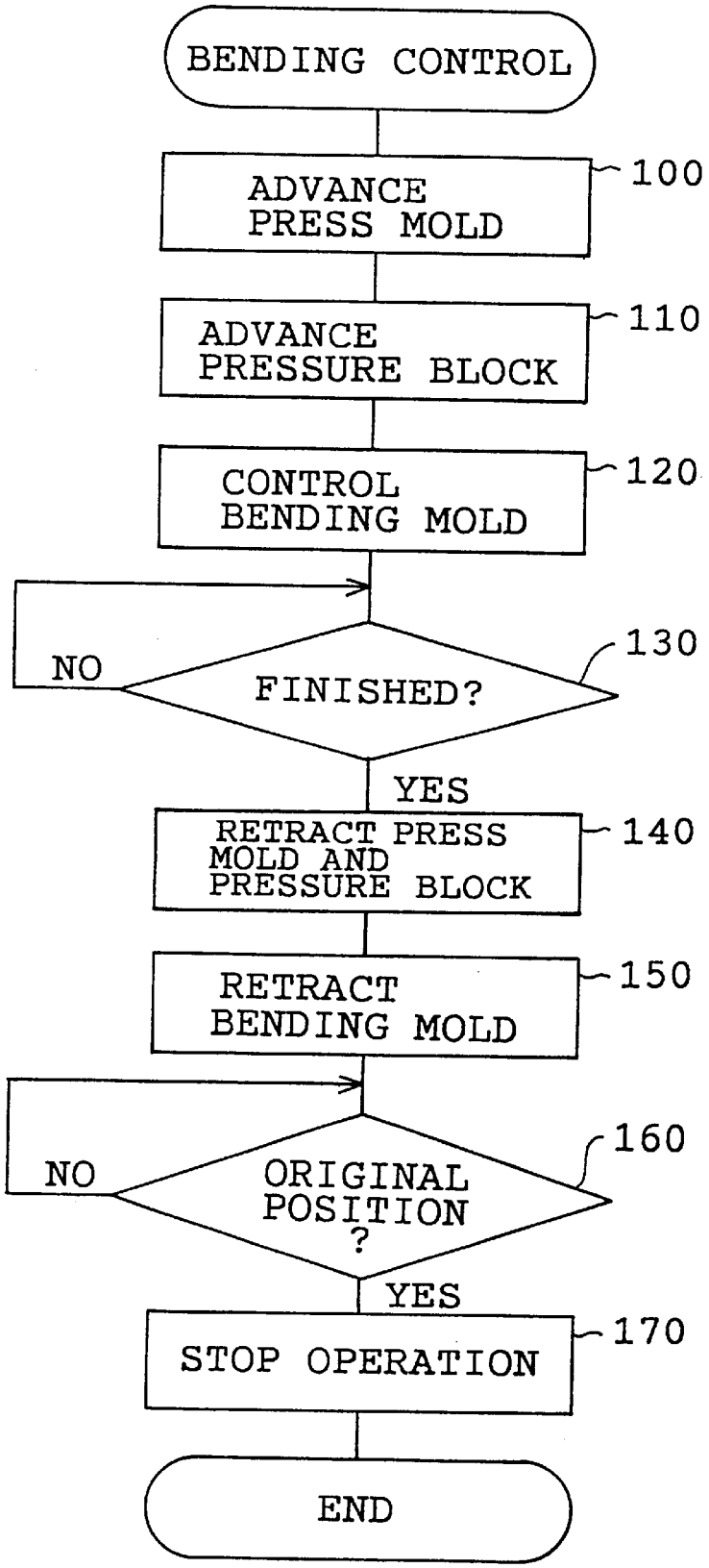
FIG. 3 is a flowchart of a bending control process executed in a control line according to the first embodiment.

A first embodiment is now explained referring to FIGS. 1–3.

As shown in FIG. 1, in the embodiment, a hydraulic pump 1 is rotatable both forwards and in reverse. The hydraulic pump 1 takes in operation liquid from a first port 2 and discharges it to a second port 4 when rotating positively, and takes in operation liquid from the second port 4 and discharges it to the first port 2 when rotating in reverse. The hydraulic pump 1 is operatively connected to a servo or electric motor 6, such that the hydraulic pump 1 can rotate both forwards and in reverse.

The first port 2 and the second port 4 are connected to a first line 8 and a second line 10, respectively. The second line 10 is connected to a plurality of hydraulic actuators, in this embodiment, first, second and third hydraulic actuators 12, 13, 14 each having a hydraulic cylinder. The second line 10 is branched to head ports 15, 16 and 17 of the first, second and third hydraulic actuators 12, 13 and 14, respectively. These hydraulic actuators 12, 13 or 14 are not restricted to being hydraulic cylinders, and may, alternatively, be hydraulic motors.

The first line 8 is connected via first, second and third electromagnetic valves 22, 23, 24 to side ports 18, 19, 20 of the first, second and third hydraulic actuators 12, 13 and 14, respectively. The actuators 12, 13, 14 are connected in parallel to the hydraulic pump 1. The first, second and third electromagnetic valves 22, 23, 24 are switched to open positions 22*a*, 23*a*, 24*a* in which the first line 8 is connected to the side ports 18, 19, 20, respectively, when actuating signals are transmitted to the first, second and third electromagnetic valves 22, 23, 24. When no actuating signal is transmitted, the first, second and third electromagnetic valves 22, 23, 24 are switched by means of spring biasing force to closed positions 22*b*, 23*b*, 24*b* in which the first line 8 is disconnected from the side ports 18, 19 and 20, respectively.

The first line 8 is connected via a first pilot check valve 32 to a hydraulic tank 30. The first pilot check valve 32 introduces liquid pressure of the second line 10 as a pilot pressure. When the liquid pressure of the second line 10 increases, the first pilot check valve 32 is opened, connecting the first line 8 and the hydraulic tank 30.

Further, the second line 10 is connected via a second pilot check valve 34 to the hydraulic tank 30. The second pilot check valve 34 introduces liquid pressure of the first line 8 as a pilot pressure. When the liquid pressure of the first line 8 increases, the second pilot check valve 34 is opened, connecting the second line 10 and the hydraulic tank 30. The hydraulic pump 1, the electromotive motor 6, the first and second lines 8, 10, the first, second and third electromagnetic valves 22, 23, 24, the hydraulic tank 30 and the first and second pilot check valves 32, 34 form a hydraulic mechanism A for bending work.

In the first embodiment, the first hydraulic actuator 12 is arranged such that displacement of the first hydraulic actuator 12 is detected by a position sensor 36. The position sensor 36 is connected to a control circuit 38. The control circuit 38 is connected to the first, second and third electromagnetic valves 22, 23, 24, such that actuating signals are transmitted to the first, second and third electromagnetic valves 22, 23, 24.

A pipe bending device, with which the hydraulic device of the first embodiment is used, will be now explained referring to FIG. 2. The pipe bending device is provided with a bending form 42 formed according to the desired bend radius of a workpiece or pipe 40. A groove 44 is formed in the outer periphery of the bending form 42 according to the diameter of the pipe 40. The bending form 42 is rotatably supported on the bending arm 46, and the bending arm 46 is rotatably operated by the first hydraulic actuator 12. The rotary angle of the bending arm 46 is detected, as shown in FIG. 1, by the position sensor 36 provided with an encoder and is transmitted to the control circuit 38.

A press form 48 is slidably supported opposite to the bending form 42 on the bending arm 46. The press form 48 is operated by the second hydraulic actuator 13, such that the pipe 40 is held between the press form 48 and the bending form 42. A wiper block 50 is disposed adjacent to the bending form 42 and a pressure block 52 is supported opposite to the wiper block 50 on a body (not shown). The pressure block 52 is operated by the third hydraulic actuator 14 and placed in contact with the pipe 40 for receiving bending stress.

Operation of the hydraulic device according to the embodiment mounted on the pipe bending device and control routine executed in the control circuit 38 are now explained referring to a flowchart of FIG. 3.

First, the pipe 40 is placed between the bending form 42 and the press form 48. Subsequently, at step 100 the press form 48 is advanced. Specifically, the electromotive motor 6 is rotated forwards, operating the hydraulic pump 1. The hydraulic pump 1 takes in hydraulic fluid from the first port 2 and discharges it to the second port 4. An actuating signal is transmitted from the control circuit 38 to the second electromagnetic valve 23, and the second electromagnetic valve 23 is switched to the open position 23*a*.

As a result, hydraulic fluid is supplied from the side port 19 of the second hydraulic actuator 13 via the second electromagnetic valve 23 and the first line 8 to the first port 2 of the hydraulic pump 1. Hydraulic fluid is then supplied from the second port 4 via the second line 10 and the head port 16 to the second hydraulic actuator 13.

In this case, there arises a difference by a volume of a cylinder rod between the quantity of operation liquid discharged from the side port 19 and the quantity of pressure liquid supplied from the head port 16. This difference is compensated for, by opening the first pilot check valve 32 by means of the pilot pressure introduced from the second line 10 to supply hydraulic fluid from the hydraulic tank 30 to the first line 8. In an alternative construction, in which the first, second and third hydraulic actuators 12, 13, 14 are composed of a double rod type hydraulic cylinders, the hydraulic tank 30 is unnecessary. When the second hydraulic actuator 13 is operated, the press form 48 is slid toward the bending form 42, and the pipe 40 is clamped between the bending form 42 and the press form 48.

Subsequently, at step 110 the pressure block 52 is advanced. Specifically, an actuating signal is transmitted to the third electromagnetic valve 24, switching the third electromagnetic valve 24 to the open position 24*a*. In the same manner as the aforementioned, hydraulic fluid is introduced from the side port 20, the third electromagnetic valve 24 and the first line 8 to the first port 2 of the hydraulic pump 1, and hydraulic fluid is supplied from the second port 4 via the second line 10 and the head port 17 to the third hydraulic actuator 14. The third hydraulic actuator 14 is thus operated, and the pressure block 52 is slid toward the pipe 40 until the pressure block 52 clamps the pipe 40 against wiper block 50.

At step 120 the bending form 42 begins to be turned. Specifically, an actuating signal is transmitted to the first electromagnetic valve 22, switching the first electromagnetic valve 22 to the open position 22*a*. Hydraulic fluid is introduced from the side port 18 via the first electromagnetic valve 22, the first line 8 and the first port 2 to the hydraulic pump 1, and hydraulic fluid is supplied from the second port 4 via the second line 10 and the head port 15 to the first hydraulic actuator 12.

By operating the first hydraulic actuator 12, the bending form 42 is rotated together with the bending arm 46. The pipe 40 is bent around the groove 44 in the bending form 42. The rotary angle of the bending form 42 is detected by the position sensor 36. It is determined at step 130 whether or not bending work is finished. When the answer to step 130 is affirmative when the rotary angle detected by the position sensor 36 has the desired rotary angle. The operation speed of the first hydraulic actuator 12 is controlled by controlling the rate of rotation of the electric motor 6.

Subsequently, at step 140 the press form 48 and the pressure block 52 are retracted. Specifically, transmission of an actuating signal to the first electromagnetic valve 22 is stopped, switching the first electromagnetic valve 22 to its closed position 22*b*, while an actuating signal is continuously transmitted to the second and third electromagnetic valves 23, 24. The second and third electromagnetic vales 23, 24 remain in the open positions 23*a*, 24*a*, respectively, and the electromotive motor 6 is rotated in reverse. Therefore, hydraulic fluid is introduced from the head ports 16, 17 of the second and third hydraulic actuators 13, 14, respectively, via the second line 10 and the second port 4 to the hydraulic pump 1. Hydraulic fluid is supplied from the first port 2 via the first line 8, the second and third electromagnetic valves 23, 24 and the side ports 19, 20 to the second and third hydraulic actuators 13, 14. By this means the press form 48 and the pressure block 52 are released from the pipe 40.

After the press form 48 and the pressure block 52 are retracted, at step 150 the bending form 42 is retracted. Specifically, transmission of an actuating signal to the second and third electromagnetic valves 23, 24 is stopped, thereby switching the second and third electromagnetic valves 23, 24 to this closed positions 23*b*, 24*b*, respectively, while an actuating signal is transmitted to the first electromagnetic valve 22, which remains in the open position 22*a*. Hydraulic fluid is introduced from the head port 15 of the first hydraulic actuator 12 via the second line 10 and the second port 4 to the hydraulic pump 1. Hydraulic fluid is supplied from the first port 2 via the first line 8, the first electromagnetic valve 22 and the side port 18 to the first hydraulic actuator 12.

By this operation the first hydraulic actuator 12, the bending arm 46 is retracted. It is determined by sensor 36 at step 160, whether or not the bending arm 46 is retracted and at step 170 the operation of all the first, second and third hydraulic actuators 12, 13 and 14 is then stopped.

The operational direction of the first, second and third actuators 12, 13 and 14 is controlled according to the rotary direction of the electromotive motor 6.

Therefore, a) changeover or large electromagnetic valves, other than the simple first, second and third electromagnetic valves, need not to be associated with the first, second and third hydraulic actuators 12, 13 and 14; b) the hydraulic tank 30 can be of a small volume and the entire size of the hydraulic device can be minimized. Further the operation of the first hydraulic actuator 12 can be controlled by only the position sensor 36, without requiring a hydraulic servo valve or other large and precise valve.

Second Embodiment

A second embodiment is now explained referring to FIGS. 4–9.

Since the second embodiment is basically similar to the first embodiment, the last two digits of the reference numerals affixed to the components according to the second embodiment are the same as those of the reference numerals affixed to the corresponding components in the first embodiment, and explanation of such components is omitted for simplicity.

Figure 4:
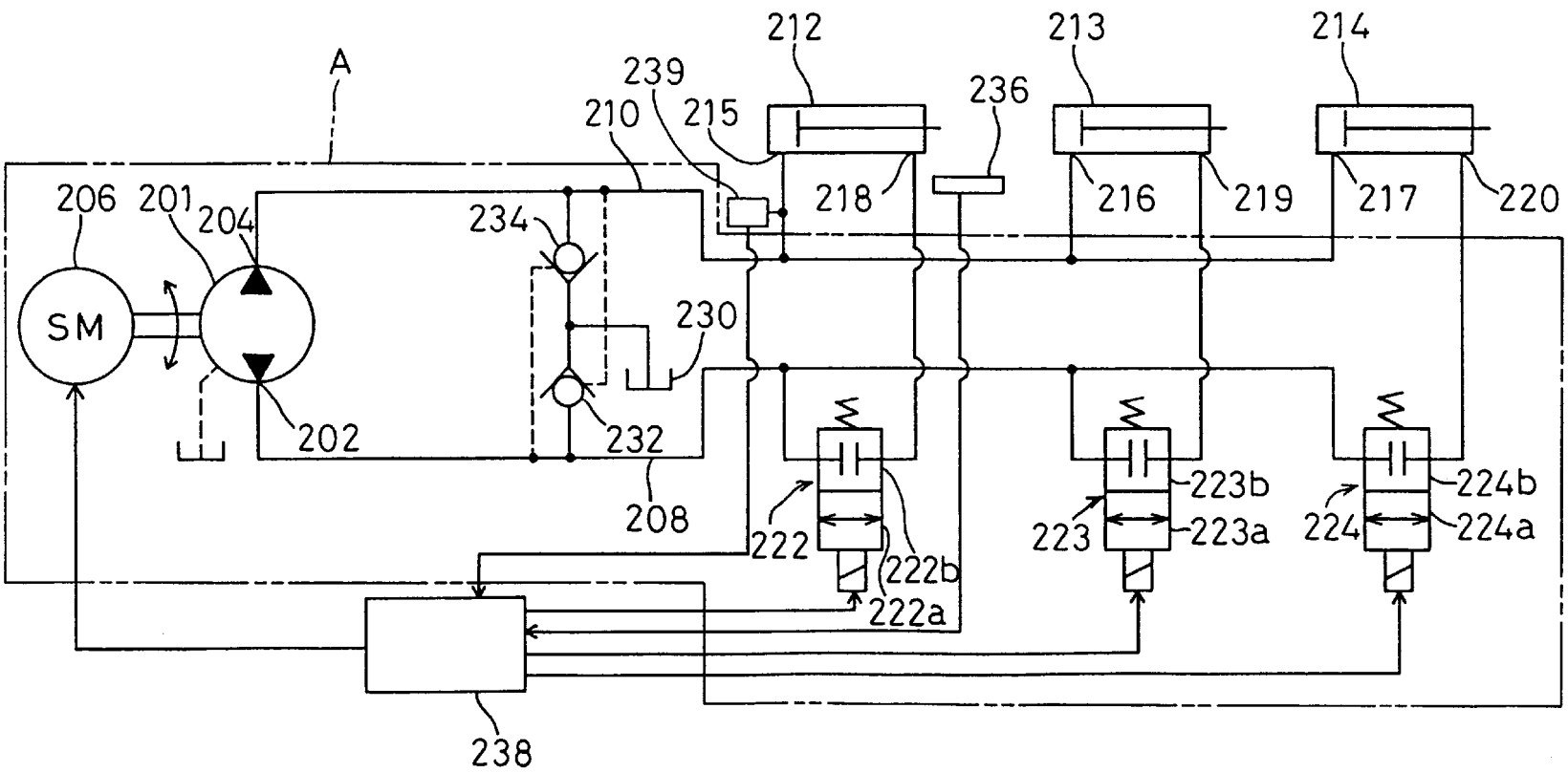
FIG. 4 is a circuit diagram of a hydraulic device for use in a bending device, according to a second embodiment of the present invention.

In the second embodiment, as shown in FIG. 4, a pressure sensor 239 is provided for detecting the pressure of hydraulic fluid supplied via the second line 210 to a first hydraulic actuator 212.

Figure 5:
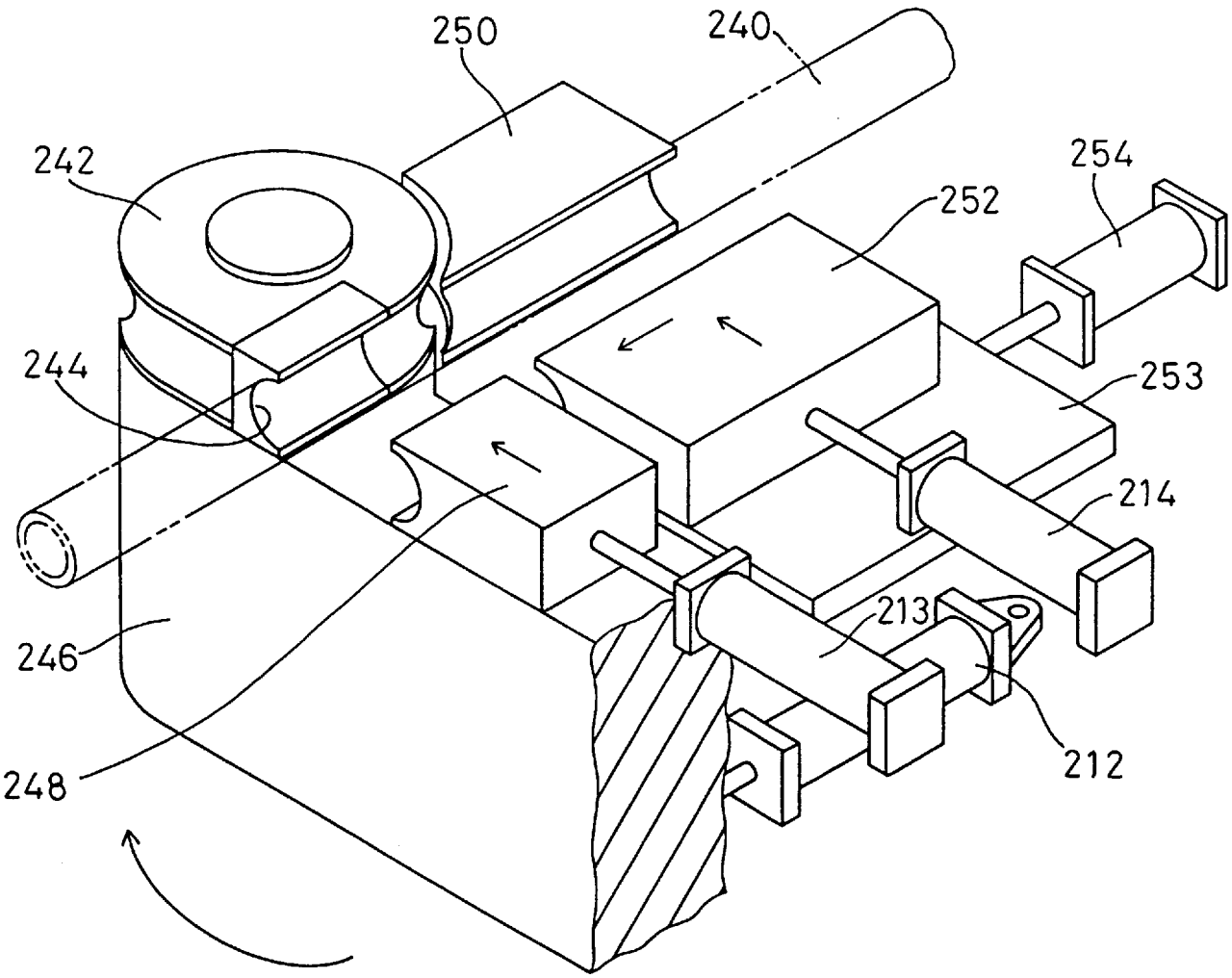
FIG. 5 is a fragmentary perspective view showing the bending device to which the hydraulic device of the second embodiment is mounted.
Figure 6:
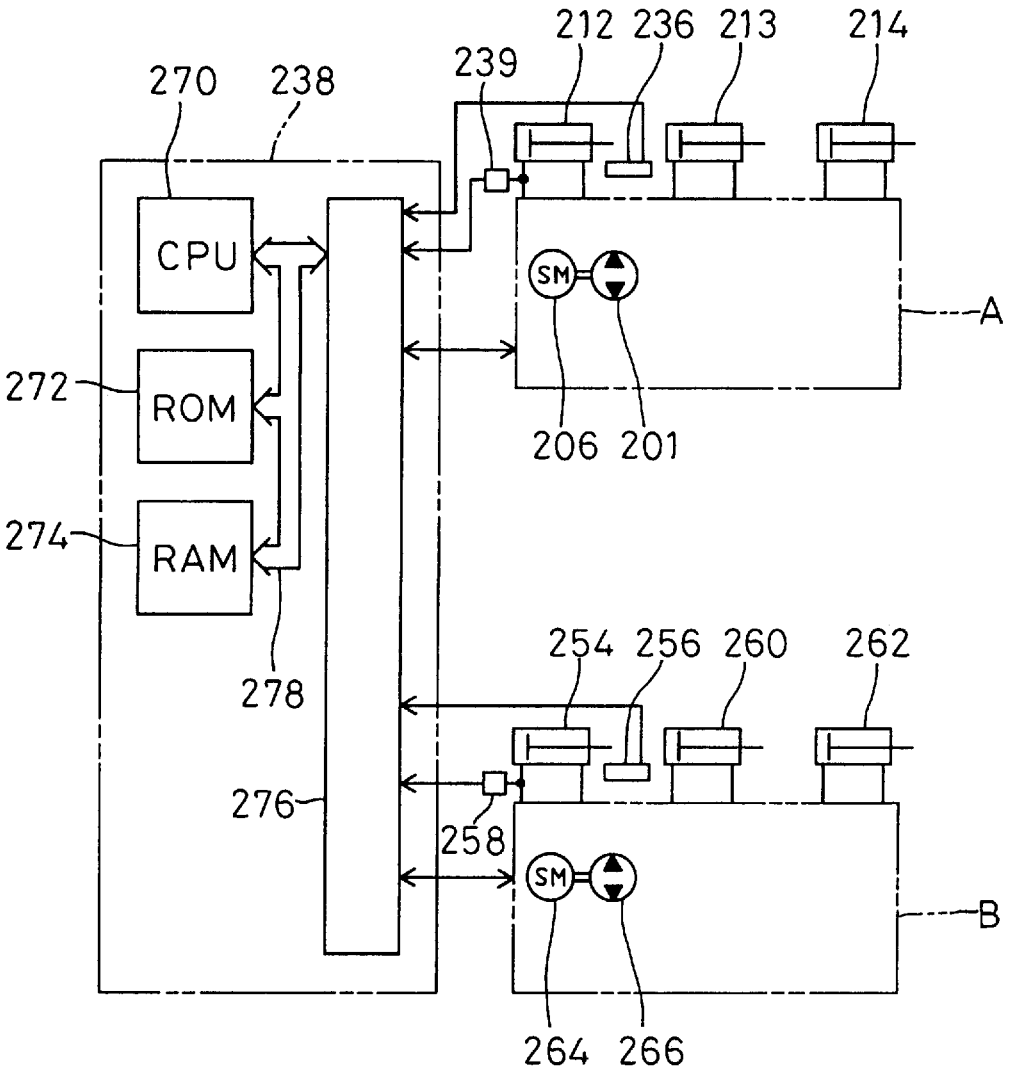
FIG. 6 is a block diagram showing an electrical system in the second embodiment.

As shown in FIG. 5, a slider base 253 is supported slidable in the axial direction of a workpiece or pipe 240, and is operated by a press hydraulic actuator 254. As shown in FIG. 6, hydraulic fluid is supplied to the press hydraulic actuator 254 by a hydraulic mechanism B for press work. The press hydraulic mechanism B has the same structure as the structure of the bending hydraulic mechanism A, which is detailed in the first embodiment. Hydraulic fluid is supplied from a hydraulic pump 266, driven by an electric motor 264, to the press hydraulic mechanism B.

As shown in FIG. 6, a speed sensor 256 is provided for detecting the operation speed of the press hydraulic actuator 254, and a pressure sensor 258 is provided for detecting the pressure of the hydraulic fluid supplied to the press hydraulic actuator 254. Further, a hydraulic actuator 260 for operating a chuck (not shown) mounted on a carriage (not shown), and a hydraulic actuator 262 for moving the chuck vertically are connected to the press hydraulic mechanism B.

A rotation sensor 236, a pressure sensor 239, the bending hydraulic mechanism A, the speed sensor 256, the pressure sensor 258 and the press hydraulic mechanism B are connected to a control circuit 238. The control circuit 238 is an arithmetic logic unit comprising of a CPU 270, ROM 272, and RAM 274, which are interconnected via a common bus 278 with an input/output circuit 276.

Input signals are transmitted from the rotation sensor 236, the pressure sensor 239, the speed sensor 256 and the pressure sensor 258 via an input/output circuit 276 to the CPU 270, which transmits operational signals, based on the input signals, the data stored in the ROM 270 and the RAM 274 and a prestored control program, via the input/output circuit 276 to electric motors 206, 264 and first, second and third electromotive valves 222, 223 and 224.

Figure 7:
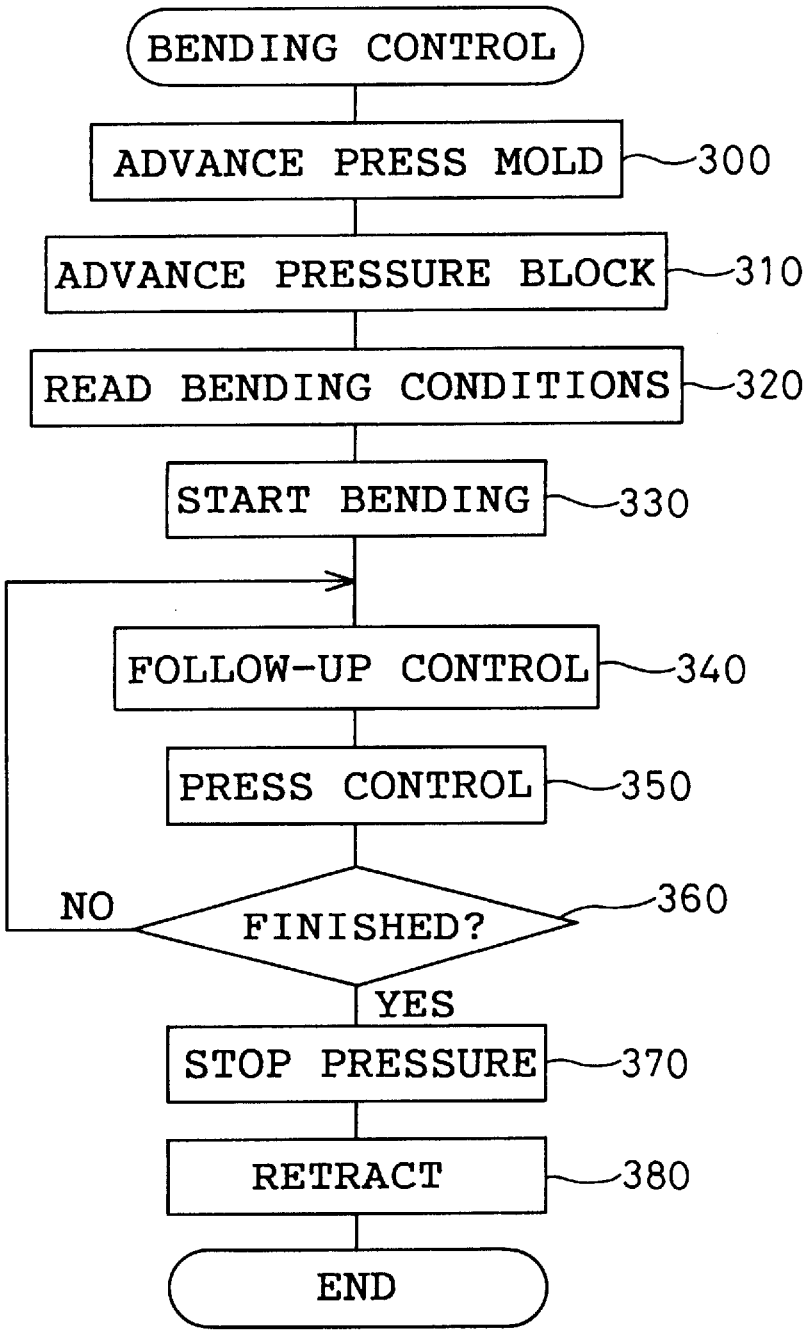
FIG. 7 is a flowchart of a bending control process executed in a control line according to the second embodiment.
Figure 8:
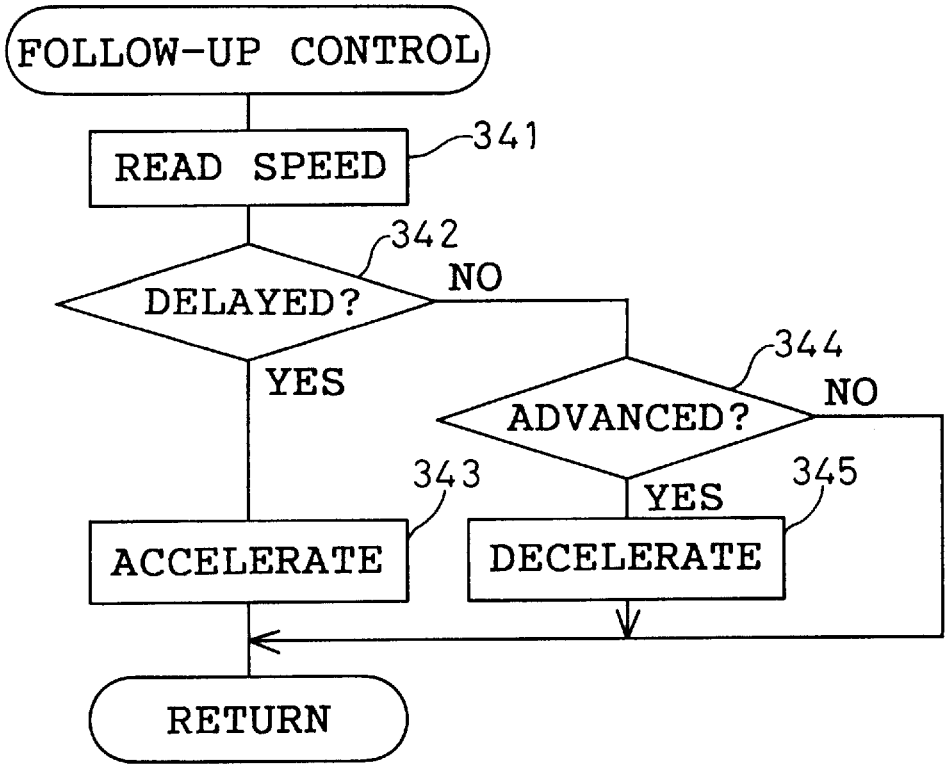
FIG. 8 is a flowchart of a follow-up control process executed in the control line according to the second embodiment.
Figure 9:
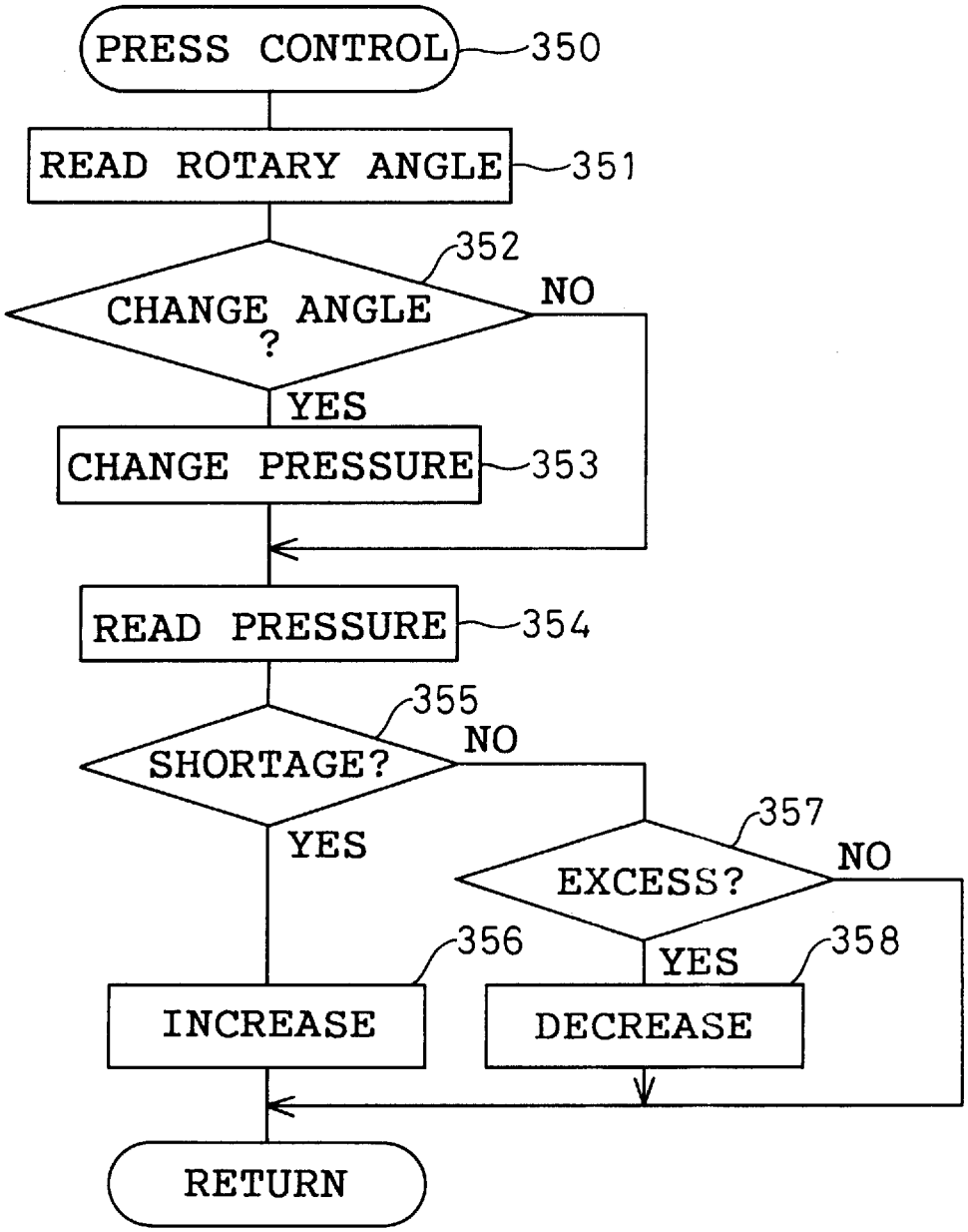
FIG. 9 is a flowchart of a press control process executed in the control line according to the second embodiment.

The control process executed in the control circuit 238 is now explained referring to flowcharts of FIGS. 7–9.

First, the rear end of the pipe 240 is grasped with the chuck(not shown) and the carriage supporting the chuck is moved, such that the pipe 240 is placed between a bending form 242 and a press form 248. Subsequently, at step 300 the press form 248 is advanced, and at step 310 a pressure block 252 is advanced. Details of the steps 300 and 310 are the same as those of the steps 100 and 110 in the first embodiment. Therefore, detailed explanation is omitted for simplicity.

Subsequently, at step 320, predetermined bending conditions are read, for example, from the ROM 272. The rotary angle of a bending arm 246, the pressure applied in the axial direction of the pipe 240 according to the rotary angle and other bending conditions are entered with a keyboard (not shown) as desired. For example, when the pipe 240 is bent perpendicularly, the rotary angle of 90 degrees, the pressure applied along the axial direction between the rotary angle 0 and 10 degrees may be 2 tons, the pressure applied between the rotary angle 10 and 80 degrees may be 1 ton, and the pressure between the rotary angle 80 and 90 degrees may be 0.5 ton entered and set.

Subsequently, at step 330 bending work is started. Specifically, an actuating signal is transmitted to the first electromagnetic valve 222, thereby switching the first electromagnetic valve 222 to an open position 222*a*. Hydraulic fluid is introduced from a side port 218 via the first electromagnetic valve 222, a first line 208 and a first port 202 to the hydraulic pump 201. Hydraulic fluid is supplied from a second port 204 via the second line 210 and a head port 215 to the first hydraulic actuator 212.

By operating the first hydraulic actuator 212, the bending form 242 is rotated together with the bending arm 246 and pipe 240 is bent around a groove 244 in the bending form 242. The rotary angle of the bending form 242 is detected by the rotation sensor 236. Based on a pulse signal transmitted from the rotation sensor 236, the rotation speed of the bending arm 246 is detected, the rate of rotation of the electric motor 206 is controlled, and the operation speed of the first hydraulic actuator 212 is controlled.

While the bending arm 246 is rotating, hydraulic fluid is supplied from the press hydraulic mechanism B to the press hydraulic actuator 254. The slider base 253 is slid and moved along the axial direction of the pipe 240, such that the pressure block 252 moves following the rotation of the bending arm 246. Follow-up control is executed at step 340.

In the follow-up control, as shown in the flowchart of FIG. 8, first at step 341, the movement speed of the pressure block 252 is read from the speed sensor 256. It is determined at step 342 whether or not the movement of the pressure block 252 is delayed, by comparing the rotation speed of the bending arm 246 detected based on a pulse signal transmitted from the rotation sensor 236 with the speed of the pressure block 252 read from the speed sensor 256.

When the answer to the step 342 is affirmative, rate of rotation of the electric motor 264 in the press hydraulic mechanism B is increased, thereby increasing the discharge rate of hydraulic fluid. At step 343 the operation of the press hydraulic actuator 254 is thus accelerated and the movement of the pressure block 252 is accelerated.

On the other hand, when the answer to the step 342 is negative, it is determined at step 344 whether or not the movement of the pressure block 252 is advanced. If the answer to the step 344 is affirmative, at step 345 the movement of the pressure block 252 is slowed by decreasing the rate of rotation of the electric motor 264 in the press hydraulic mechanism B. After the step 343 is executed or the step 345 is executed, the process returns to the original step.

Returning to the flowchart of FIG. 7, at step 350 press control is executed. By controlling the pressure of hydraulic fluid supplied from the press hydraulic mechanism B to the press hydraulic actuator 254, the pressure applied via the pressure block 252 in the axial direction to the pipe 240 is controlled.

The press control is now explained referring to the flowchart of FIG. 9. First at step 351 the rotary angle of the bending arm 246 is read from the rotation sensor 236.

Subsequently, it is determined at step 352 whether or not the rotary angle has reached the desired angle read at step 320 in the flowchart of FIG. 7. This desired angle first corresponds to 10 degrees. If the rotary angle does not reach 10 degrees, at step 354 detected pressure is read from the pressure sensor 258 in the press hydraulic mechanism B.

It is determined at step 355 whether or not there is a insufficient pressure. It is determined whether or not the pressure detected by the pressure sensor 258 is below the set pressure corresponding to the pressure of, for example, 2 tons applied in the axial direction between the rotary angle 0 and 10 degrees. If the pressure is low, at step 356 the pressure applied to the pipe 240 is increased, by increasing the limitation of electric current driving the electric motor 264.

By increasing the current to the electric motor 264, the drive torque of the hydraulic pump 266 is increased, and the pressure supplied from the hydraulic pump 266 is increased as desired.

If the answer to step 355 is negative, it is determined at step 357 whether or not there is an excess of pressure. If there is an excess of pressure, at step 358 the pressure applied to the pipe 240 is decreased, by decreasing the electric current driving the electric motor 264. The drive torque of the hydraulic pump 266 is thus decreased and the pressure supplied from the hydraulic pump 266 is decreased.

When after repeating the steps it is determined at step 352 that the rotary angle exceeds 10 degrees, at step 353 the set pressure is changed corresponding to the pressure applied in the axial direction of, for example, 1 ton between the rotary angle 10 and 80 degrees. Subsequently, by executing the step 354 and the following steps, the maximum pressure supplied from the hydraulic pump 266 is increased or decreased as aforementioned, such that the set pressure is reached. When the rotary angle of the bending arm 246 is between 80 and 90 degrees, at step 353 the set pressure is changed corresponding to the pressure applied in the axial direction of, for example, 0.5 ton. Subsequently, by executing the step 354 and the following steps, the maximum pressure supplied from the hydraulic pump 266 is increased or decreased as aforementioned, such that the set pressure is reached.

Returning to the flowchart of FIG. 7, it is determined at step 360 whether or not bending work is completed, by determining whether or not the rotary angle detected by the rotation sensor 236 has reached the predetermined angle, for example, of 90 degrees. If the answer to the step 360 is negative, the aforementioned steps 340 and 350 are repeated.

If the answer to the step 360 is affirmative, at step 370 the application of pressure in the axial direction of the pipe 240 is stopped by stopping the supply of hydraulic fluid to the press hydraulic actuator 254. Subsequently, at step 380 the bending arm 242, the press form 248 and the pressure block 252 are retracted in similar manner to that described with reference to the first embodiment illustrated in FIGS. 1–3.

In the second embodiment, by operating the slider base 253 by means of the press hydraulic actuator 254, pressure is applied via the pressure block 252 in the axial direction to the pipe 240. Alternatively, by pushing the rear end of the pipe 240 with another press hydraulic actuator, the pressure can be applied in the axial direction.

While pressure is applied via the pressure block 252 along the axial direction of the pipe by the press hydraulic actuator 254, the rear end of the pipe 240 can be directly pushed by another press hydraulic actuator. In this case, since pressure is given along the axial direction of the pipe 240 in two manners, two press hydraulic mechanisms B need to be provided.

In the bending device according to the second embodiment, the rotation sensor 236 is mounted on the first hydraulic actuator 212 and the operation of the first hydraulic actuator 212 can be controlled by rotating the electromotive motor 206, obviating the necessity of a hydraulic servo valve or other large, precise valve. When a plurality of hydraulic actuators are connected to the bending hydraulic mechanism A, it is determined which actuator be operated by switching the first to third electromagnetic valves 222–224. No large changeover or electromagnetic valve is required for the first to third actuators 212–214. The hydraulic circuit can be formed by the first to third electromagnetic valves 222–224 having a simple structure. The hydraulic tank 230 also can have a small volume. The entire size of the hydraulic device can be small.

Further in the second embodiment, the press hydraulic mechanism B and the press hydraulic actuator 254 for driving the slider base 253 are provided. The pressure block 252 can be moved following the rotation of the bending arm 246 in a simplified hydraulic structure. Since the pressure sensor 258 is provided, the pressure applied in the axial direction to the pipe 240 can be controlled by controlling the maximum pressure supplied to the press hydraulic actuator 254.

What is claimed is:

1. A bending device provided with a bending form formed according to a desired bending configuration of a longitudinal workpiece, a bending arm rotatably supported about said bending form, and a press form movably supported on said bending arm, said press form being moved toward said workpiece until said workpiece is held between said bending form and said press form and said bending arm being rotated by hydraulic fluid supplied to a bending hydraulic actuator having two ports for bending said workpiece, comprising:

a bending hydraulic mechanism having a bidirectional hydraulic pump, having two ports, operated by a motor and being rotatable both clockwise and counterclockwise in response to clockwise and counterclockwise rotation of said motor; and a connecting line for connecting both ports of said hydraulic pump to both ports of said hydraulic actuator;

a rotation sensor for detecting a rotary angle of said bending arm; and a control circuit for controlling said motor based on the rotary angle detected by said rotation sensor, and controlling an operation direction of said bending hydraulic actuator by rotating said motor clockwise or counterclockwise.

2. A bending device according to claim 1, comprising:

a press hydraulic actuator, having two ports, for applying pressure in an axial direction to said workpiece;

a press hydraulic mechanism including a connecting line for connecting both ports of said hydraulic pump to both ports of said press hydraulic actuator; and a speed sensor for detecting an operation speed of said press hydraulic actuator; and a follow-up control means for controlling the rate of rotation of said motor based on the rotary angle detected by said rotation sensor and the operation speed detected by said speed sensor, such that said press hydraulic actuator is operated according to rotation of said bending arm.

3. A bending device according to claim 1, comprising:

a press hydraulic actuator, having two ports, for applying pressure in an axial direction to said workpiece;

a press hydraulic mechanism including a connecting line for connecting both ports of said hydraulic pump to both ports of said press hydraulic actuator;

a pressure sensor for detecting the pressure of hydraulic fluid supplied from said press hydraulic mechanism to said press hydraulic actuator; and a press control means for controlling the maximum pressure supplied to said press hydraulic actuator by controlling power output of the motor based on the rotary angle detected by said rotation sensor.

4. A bending device according to claim 1, comprising:

a press hydraulic actuator, having two ports, for applying pressure in an axial direction to said workpiece;

a press hydraulic mechanism including a connecting line for connecting both ports of said hydraulic pump to both ports of said press hydraulic actuator;

a speed sensor for detecting an operation speed of said press hydraulic actuator;

a pressure sensor for detecting the pressure of hydraulic fluid supplied from said press hydraulic mechanism to said press hydraulic actuator;

a follow-up control means for controlling the rate of rotation of said motor based on the rotary angle detected by said rotation sensor and the operation speed detected by said speed sensor, such that said press hydraulic actuator is operated according to rotation of said bending arm; and a press control means for controlling the maximum pressure supplied to said press hydraulic actuator by controlling the power output of the motor based on the rotary angle detected by said rotation sensor.

5. A bending device according to claim 2, wherein said press hydraulic actuator is operable to move a pressure form for relieving bending stress in an axial direction of said workpiece during bending thereof.

6. A bending device according to claim 2, wherein said press hydraulic actuator is operable to push a rear end of said workpiece in an axial direction.

7. A hydraulic device comprising:

a plurality of hydraulic actuators;

a control circuit including a hydraulic pump having two ports for supplying hydraulic fluid to said plurality of hydraulic actuators having two ports and under the control of the control circuit, such that said plurality of hydraulic actuators are operated in a desired operation order;

a plurality of electromotive valves controlled by the control circuit, each of said plurality of electromotive valves being connected to each of said plurality of hydraulic actuators; and a connecting conduit for connecting both ports of each of said plurality of hydraulic actuators in parallel with both ports of said hydraulic pump; and a motor for rotating forwardly and in reverse for operating said hydraulic pump operable both clockwise and counterclockwise, wherein each of said plurality of hydraulic actuators is controlled by opening or closing each of said plurality of electromotive valves and an operation direction of said plurality of hydraulic actuators is controlled by rotating said motor forwardly or in reverse.

8. A hydraulic device according to claim 7, further comprising a position sensor for detecting displacement of one specified hydraulic actuator selected from said plurality of hydraulic actuators, wherein said motor is controlled by said control circuit based on a signal transmitted from said position sensor.

9. A hydraulic device according to claim 7, wherein each of said hydraulic actuators is a hydraulic cylinder having a cylinder rod, said hydraulic device includes a hydraulic tank said tank having a volume at least corresponding to a volume of said cylinder rod and said tank is connected via a pilot check valve to both ports of said hydraulic pump.

* * * * *